United States Patent [19]

Benno

[11] 4,454,705

[45] Jun. 19, 1984

[54] PACKAGING METHOD

[76] Inventor: Edward L. Benno, Rte. 1, Box 198, Grayslake, Ill. 60030

[21] Appl. No.: 241,358

[22] Filed: Mar. 6, 1981

[51] Int. Cl.[3] ..... B65B 13/02; B65B 27/04

[52] U.S. Cl. ..... 53/399; 53/441; 53/398

[58] Field of Search ..... 53/441, 556, 585, 291, 53/292, 293, 399, 398

[56] References Cited

U.S. PATENT DOCUMENTS

| | | | |
|---|---|---|---|
| 2,843,984 | 7/1958 | Dunning | 53/556 |
| 2,864,212 | 12/1958 | Bruce | 53/556 X |
| 3,264,796 | 8/1966 | Tomczak | 53/585 X |
| 3,313,090 | 4/1967 | Kerrigan | 53/556 X |
| 3,386,371 | 6/1968 | Farmer | 53/585 X |
| 3,714,756 | 2/1973 | MacInness | 53/556 X |
| 3,774,367 | 11/1973 | Lerner | 53/556 |
| 3,811,986 | 5/1974 | Mare | 53/585 X |
| 3,961,959 | 6/1976 | Wolske | 53/441 X |
| 3,974,628 | 8/1976 | Konstantin | 53/585 X |
| 4,286,421 | 9/1981 | Fujio | 53/585 X |
| 4,309,861 | 1/1982 | Karpisek | 53/556 |
| 4,354,333 | 10/1982 | McArdle | 53/556 X |
| 4,403,463 | 9/1983 | Danti | 53/441 |

FOREIGN PATENT DOCUMENTS

| | | | |
|---|---|---|---|
| 2035250 | 6/1980 | United Kingdom | 53/556 |

*Primary Examiner*—John Sipos

[57] ABSTRACT

A packaging method and apparatus for making a package which comprises a generally rectangularly shaped article or group of articles encircled by a broad band of a highly-stretched, resilient, elastic plastics material. The method and apparatus use a plurality of elongated flat rigid arms to stretch the band, permit the article to be placed therein, and to then transfer the high compressive force of the stretched band from the arms to the corners of the article by moving the arms in the flat planes of the inner surface of the stretched band from the article corners toward the centers of the stretched band panels. Low compressive forces between the arms and the inner surfaces of the band then permit the arms to be easily longitudinally slid from the package.

5 Claims, 11 Drawing Figures

PACKAGING METHOD

BACKGROUND OF THE INVENTION

Banding of articles with a plastics film material is a widely known procedure. Rolls of thin plastic film are commonly sold to householders, generally for use in the kitchen to wrap foods. Such films in various chemical compositions are also widely used in what is called the shrink film art. In that art, articles of many different sizes and shapes are encircled with a relatively loose band of plastic film and then heated to cause the film to melt from the crystalline state to the amorphous state and thereby shrink about the article. Subsequent cooling returns the film to the crystalline state. Articles so packaged often have the appearance of a stretched film band because of the close conformity of the film to the article, but such bands exert no compressive forces on the packaged article.

With the growth of the plastic film industry many stretched film applications have been developed. Such films are commonly elastomeric materials made by blowing processes from a polymer such as polyethylene. Other polymers and many different additives are available to make films with various desireable properties such as high elasticity, high recovery rates and excellent creep resistance. Commonly those films are blown with wall thicknesses of from 1 to 4 mils. With such films an object can be wrapped or banded by stretching the film in application or prior to application, and in the resulting package high compressive forces of the film on the object will be maintained for considerable periods of time. Generally, the higher the initial stretching forces, the higher will be the resulting compressive forces of the stretched film. However, if the elastic limit of the material is exceeded in the stretching operation, the material will lose its elasticity and no longer produce elastic compressive forces.

One substantial commercial use of stretch film is for the wrapping of pallet loads of boxes. Usually a 1 mil thick, 12 inch wide, roll of stretch film is highly stretched and wound spirally in layer after layer about a pallet load of boxes. A very tightly and resiliently maintained pallet load is achieved which can be shipped great distances by rail or truck. Other applications for stretch film are known in the prior art, but they generally appear to involve relatively low degrees of stretch. One such application is for the packaging of frozen turkeys. A bag or tube of a plastic material with a relatively low recovery rate is initially radially stretched with a plurality of extending arms. The turkey is then placed within the stretched tube and the arms are then quickly radially retracted and axially drawn from the tube before the plastic can recover. Another low stretch application, which is often used for labeling, involves the radial stretching of a plastic tube with fingers, plates or rods followed by the insertion of the object to be packaged or labeled. Then with some slight retraction of the stretching fingers against the object, jaws, pads or other devices are then pressed against the film and the underlying object with a force sufficiently great to permit the object with the film thereabout to be drawn from the stretching fingers. It has been found that the foregoing procedure is impractical when the bands are highly-stretched because more often than not the film is torn, distorted or destroyed in the attempted withdrawal of the stretching elements.

One suitable arrangement in various embodiments is known which can apply a highly-stretched, relatively-thin and broad plastic film band about the body portions of a plurality of bottles. In that arrangement a plurality of generally curved jaw plates are inserted in a film band and then rotated or otherwise moved to stretch the band. The bottles are then placed within the band and the jaws are moved circumferentially about the surface of the bottles until they enter into the open spaces between adjacent bottles and the inner surface of the band. The package of bottles can then be easily removed from the stretching jaws. The foregoing arrangement is obviously not suitable for banding or packaging boxes or like articles because of the lack of any open areas into which the stretching elements may be removed.

SUMMARY OF THE INVENTION

The subject invention is concerned with a simple method and apparatus for banding box-like objects with a broad band of a highly-stretched resilient, elastic plastics material for use in areas of the packaging art where such banding is desireable. The subject invention is not concerned with low stretch banding nor with bands which have an axial direction length approximating the band thickness. In the areas of the art to which the subject invention is directed the subject invention overcomes the limitations of and has many advantages over prior known methods and apparatus. Practice of the subject invention does not require the use of any clamping jaws to grasp and pull a package from the band stretching elements, nor must the article to be banded be required to have open areas into which the band stretching elements can retract. Importantly in an energy conscious world, practice of the subject invention permits one to make tight resiliently secure packages with less material and lower energy requirements than prior known packaging arrangements involving the wrapping or banding of box-like objects with plastic film. By highly stretching the band a smaller initial band may be used to save material, and with the further advantage of using the tight compressive qualities of known plastic stretch films. Also, no heat is used to shrink the band, and thereby partially reverse the process by which such films are made, the heating, blowing and cooling of a resin.

Because of the steps of the method and the construction and operation of the apparatus of the invention, further advantages resulting over prior known arrangements are that the band can be broader or axially longer, the film material thickness can be less, and a greater degree of stretch more closely approaching the elastic limits of the material may be produced, without tearing or destroying the film in application. The use of a broader band permits box-like articles to be more completely covered, and permits a group of articles to be multipackaged with greater package integrity. The use of thinner films increases the range of applicability of the invention to various packaging constructions while keeping material costs down. For example, two thin broad bands at right angles to each other about a box can substantially completely envelope the box with a minimum use of total material. Further, it is believed that in some packaging situations use of the subject invention will permit the top and bottom flaps of a cardboard shipping box to be more economically and effectively sealed than with the present uses of adhesives, tapes or staples. Additionally, in reductions to practice of the invention it has been found that a broad, thin, highly-stretched film band about a box is substantially impossible to remove without tearing or destroying the band, and thus such a package is advantageous where tamper proof box closures are desired. The use in the invention of bands which are stretched to a degree closely approaching the elastic limits of the material provides for maximum compressive forces of the band about the article with a minimum use of material. Such uses are advantageous in the securing of shipping pallet loads of boxes or in some multipackaging situations because the high compressive forces of the band about a plurality of box-like objects can more effectively hold those objects within the group which are not in substantial direct frictional contact with the inner surfaces of the band.

Briefly, the method and apparatus of the subject invention are directed to the resilient high compressive banding of an article or group of articles having at least three sides adjacent to each other in one direction circumferentially about the article or group which are generally rectangular in outline and generally flat. Thus it should be understood that the subject invention is not applicable to the banding of an object which is generally cylindrical such as a drum or a bottle that is circular in transverse cross section. However, the invention may be practiced upon a compound article such as a shallow rectangular tray filled with a large number of upstanding side-by-side cans where the can edges in combination define what may be called interrupted straight line corners at the juncture of the plane of the upper surface of the cans with the planes of the can side walls. Presently, such trays of 24 cans of soda-pop are often shipped to supermarkets with a heat shrunk plastic band thereabout.

In the broad method of the invention a circumferentially continuous band of a resilient elastic plastic film material of substantial axial length and of a circumferential dimension substantially less than the circumferential dimension about the at least three sides of the article is provided. Further, at least three substantially straight, rigid and essentially flat arms are provided. The arms are telescopically inserted within the provided band and are then moved laterally apart to highly stretch the band and to define an area within the band and between the arms which will permit the article to be placed within the band with each corner line of the article, in one direction circumferentially thereabout, closely adjacent to one of the arms and between the longitudinal edges of one side thereof. The article is then so placed within the band. Thereafter each of the arms is moved away from the adjacent article corner in the flat plane of the inner surface of the band contiguous with the outward wider side of the arm and toward the center of that flat plane at least until the band is carried on the article corners. The last step in the broad method is a sliding removal of the arms from between the article and the inner surfaces of the band by a movement of the arms in a direction longitudinally thereof. Because in the stretched-band article application step the large compressive forces of the band on the arm corners are virtually immediately transfered to the article corners upon substantially the initial movement of the arms as described, a low arm movement force is required and the band is transfered with a minimum of distortion or disturbance thereto. After the band transfer, compressive forces of the band on the arms are very low compared to the compressive forces of the band on the article corners and the arms can be easily slid longitudinally from the package with substantially no disturbance of the applied band. What has been said about the lack of distortion or disturbance forces between the inner surfaces of the band and the arms also substantially applies between the arms and surfaces of the article, and thus highly decorated or labeled articles can be easily banded with the described highly stretched band. In reductions to practice of the invention, it has been found that the last step of arm removal need not be accompanied by any external holding forces between the band and the article. It has also been found that the necessary amount of arm movement against the band for band-to-article application is substantially less than for any known prior art arrangement with a resulting substantial reduction in arm wear.

In the broad apparatus of the invention at least four arms are provided with means for holding the arms in an extending manner close enough together to receive the unstretched band thereabout. The apparatus includes other means for moving the arms apart laterally to stretch the band and to attain a position permitting the article to be placed within the band with each of four corners of the article longitudinally adjacent one of the arms. Another means is provided for moving each of the arms in the flat plane of the inner surface of the band which is contiguous thereto and away from the adjacent article corner until the stretched band engages each of the four corners of the article with a compressive force substantially greater than the compressive force of the band against the arms.

The primary object of the invention is to provide a method and apparatus for banding a box-like article or group of articles with a highly-stretched circumferentially continuous band of a resilient elastic plastics material wherein the band is of substantial axial length.

Other objects and features of the invention will be apparent upon a perusal of the hereinafter detailed description read in conjunction with the drawings.

DETAILED DESCRIPTION OF THE INVENTION

Figure 3:
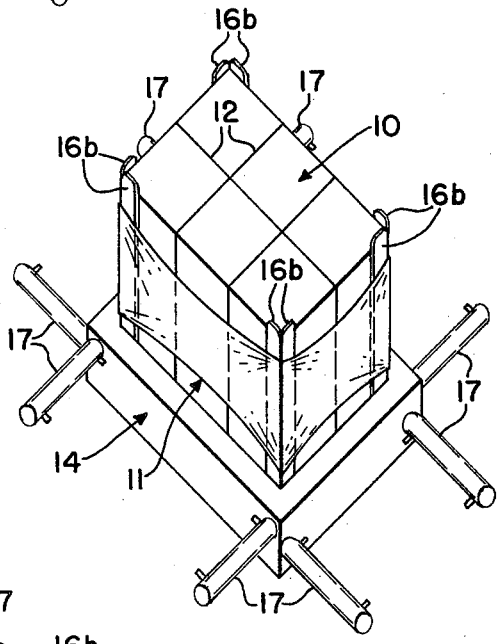
FIG. 3 is a view similar to FIG. 2 showing the article to be banded within the band.
Figure 4:
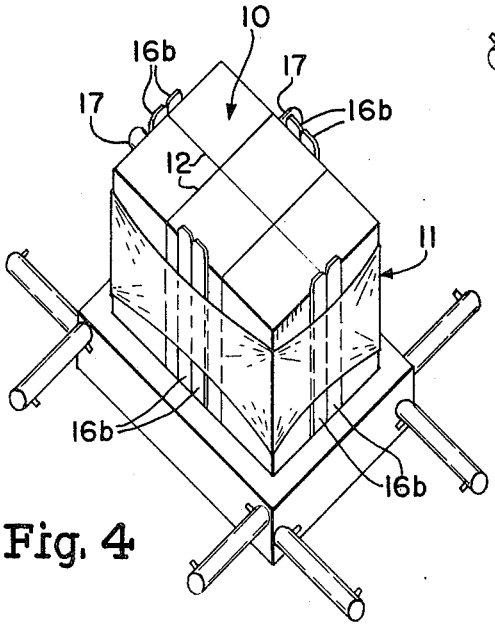
FIG. 4 is a view similar to FIG. 3 but showing the arms moved to transfer the stretched band to the article.
Figure 5:
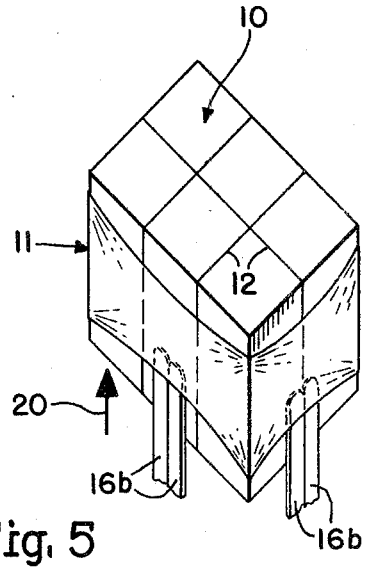
FIG. 5 is a fragmentary view of FIG. 4 showing the relative separation of the completed package and the arms.

The method and apparatus of the invention in the various embodiments thereof are intended to be used for the packaging of various generally box-like or rectangularly shaped articles. By way of example, the article 10 shown in FIGS. 3–5 is one form of article intended to be packaged through the use of the invention. As shown, each of the six sides of the article 10 has a rectangular shape lying in a flat plane with the four vertically disposed sides being the sides about which the band 11 is intended to be placed. It should be noted that with the intended band placement the upper and lower sides of the article 10 need not be rectangular flat planes but might take other shapes involving curved or compound surfaces. The lines 12 on the article 10 are intended to point out that the article may be any appropriate group of articles, such for example as six boxes placed in a side-by-side arrangement, or perhpas six boxes on top of six boxes. Further, an understanding of the invention will make clear that the four corners of the article 10 about which the band 11 is placed need not be sharp right angle corners, nor that they be limited to four in number, nor that the corner lines be perfectly straight, nor that the corner lines be continuous or uninterrupted. By way of further example the article 13 shown in the embodiment of FIGS. 6–9 comprises a shallow cardboard tray with thirty two cans placed therein in a side-by-side upstanding array.

The packaging band of the invention such as band 11 of the embodiment of FIGS. 1–5 and band 29 of the embodiment of FIGS. 6–9 is a circumferentially continuous band of a resilient elastic plastics material having a relatively high recovery rate when stretched to any degree below the elastic limits thereof at normal ambient temperatures. The band may be made circumferentially continuous in the blowing process of manufacture by blowing a layflat tubing of the proper circumferential dimension for the circumferential dimension of the article to be banded, and then transversely cutting the tubing to provide bands of the desired length measured in the axial direction. If the band is made from sheet material stock care must be taken to make the band seam strong enough to avoid separation when the band is highly stretched to degrees approaching the elastic limits of the material. It has been found that heated bar and platen seaming arrangements more often than not result in a relatively weak band because immediately adjacent to each side of the seam the plastic material is thinner than the sheet material used to make the band.

A preferred band material is low density polyethylene in commercially available compositions designated as having relatively high recovery rates and good creep resistance. By definition a material with a low recovery rate is one that upon being substantially stretched to some degree below the elastic limits thereof and then released will not substantially immediately return to its original unstretched size, although it will over a period of hours or days. In the practice of the subject invention use of the preferred material insures that as the stretching arms move to transfer the stretched band to the article, the recovery or attempted contraction of the band causes substantially immediate high compression forces of the band on the article corners. By definition good creep resistance is the ability of the plastic material to maintain the relatively high compression forces of the stretched band about the article for a considerable period of time. In practicing the subject invention a commercial plastic material which will maintain its compressive forces for the desired life of the package should be selected. For most commercial packaging applications a life of from six months to a year is adequate.

The preferred band material thickness is the minimum thickness which will adequately secure the article for the intended package use. Suitable plastic materials, which are commonly called films, are readily available in thicknesses from under 1 mil to about 5 mils. In reductions to practice of the invention 2 mil films were used on cardboard shipping cartons or boxes roughly one foot square and the resulting packages were tight and secure and appeared to take rough handling with continued high package integrity.

The preferred band length is that which will cover enough of the article to provide a package suitable for its intended purposes. In most instances, the preferred band length would be substantially equal to length of the corner lines of the article about which the band is to be placed.

The preferred initial circumferential dimension of the band is that which is sufficiently smaller than the circumferential dimension about the article, measured in the direction of intended encirclement, to provide that the material of the band will be stretched close to the elastic limits thereof when stretched and applied about the article. In reductions to practice of the invention using the preferred plastic materials it has been found that the preferred minimum degree of band stretch is about 20% with the maximum appearing below a 50% elongation. Using those preferred band stretch limits it may be seen that a 10 inch wide lay-flat band of 20 inches circumferential dimension would be preferred for articles having a circumferential dimension of between 24 inches and 30 inches. Obviously, the above described parameters for the band are based on the necessary assumption that the article is sufficiently rigid and stable not to collapse under compressive forces of the applied band.

Figure 10:
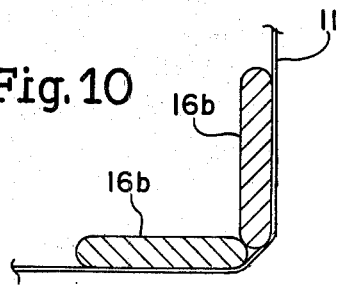
FIG. 10 is an enlarged cross sectional view of a portion of the apparatus of FIG. 2 and taken substantially along the line 10—10 of FIG. 2.
Figure 11:
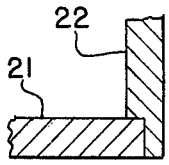
FIG. 11 is an enlarged fragmentary view of structure such as shown in FIG. 10 but showing another embodiment thereof.

FIGS. 1–5 show one embodiment of the invention in five different operated conditions, and FIGS. 6–9 show another embodiment in four different operated conditions. Many of the parts are shown somewhat schematically and some parts which normally would be part of a complete machine are omitted in an attempt to clearly and concisely describe the invention. Those skilled in this art will be readily able to understand the various parts and their locations and arrangements in complete machines. FIGS. 10 and 11 show various stretching arm details, and it should be understood that many of the parts may be modified or interchanged between the embodiments within the skill of those skilled in this art.

Figure 1:
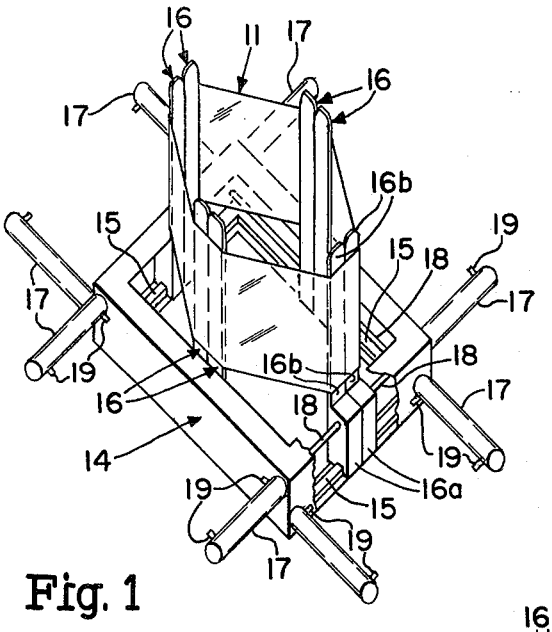
FIG. 1 is an isometric view of one embodiment of the invention showing the stretching arms in band receiving position.

As shown in FIG. 1 a rigid rectangular frame 14 open in the center is provided. In vertical cross section each side of the frame 14 is U-shaped and the inner surface of the lower leg of each side of the frame 14 is provided with a way 15 for directed sliding movement of the stretching members 16 therealong.

In the subject embodiment, eight stretching members 16 are provided. The stretching members 16 are substantially identical in construction and each member 16 comprises a mounting section **16*a* and an extending section 16*b*. The mounting section 16*a* has a lower side formed to slide on the way 15, and an upper side formed to slide on the under side of the upper leg of the frame 14 to thereby limit each mounting section 16***a* to sliding movement longitudinally of its way 15. The extending section 16*b* comprises a flat elongated arm of substantially greater width than thickness which is rigidly carried on the mounting section 16*a* to upstand therefrom. The elongated arm of the extending section 16*b* must be made of a material rendering the arm sufficiently rigid to avoid any substantial bending thereof toward a vertical axis through the center of the frame 14 when the stretching members 16 are laterally moved to stretch the band 11. The elongated arm of each extending section 16*b* should have a length at least as long as length of the band 11 to be applied about the article 10. The arm can be shorter than the total length of the band 11 but in that situation any portion of the band above the arm will tend to fold over the upper surface of the article 10 when the band 11 is applied thereabout. As is obvious from the drawings, the arm of the extending sections 16*b* can be longer than the band 11 if convenient.

Eight reciprocating motors 17 are provided to laterally move the stretching members 16. As shown, the motors 17 may comprise double-acting fluid cylinders with a piston (not shown) therein connected to a piston rod 18 extending from the rod end of each cylinder, and with fluid ports 19 at each end of each cylinder. Each cylinder 17 is mounted at its rod end on the outer side wall of the frame 14 with its piston rod 18 extending therethrough and to a connection with the mounting section 16*a* of one of the stretching members 16. A portion of the walls of the frame 14 are removed in FIG. 1 to show that connection. To avoid piston rod interference, four of the cylinders 17 are mounted adjacent the upper leg, and the other four are mounted adjacent the lower leg of the frame 14.

The operation of the embodiment of FIGS. 1–5 can be understood by following the series of FIGS. 1–5. As shown in FIG. 1, all of the cylinders 17 have been extended to place the stretching members 16 in pairs with one pair substantially at the longitudinal center of each side of the frame 14. In that position the circumferential dimension about the extending sections 16*b* is a minimum and the band 11 in a substantially unstretched condition is then placed about the extending sections 16*b* substantially as shown.

Figure 2:
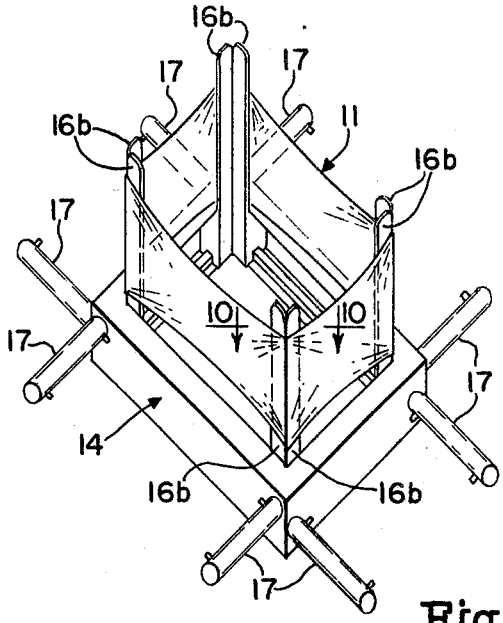
FIG. 2 is a view similar to FIG. 1 but showing the arms moved to place the band in a stretched condition.

The cylinders 17 are then substantially completely retracted to position the extending sections 16*b* at the inner corners of the frame 14 as shown in FIG. 2. That lateral movement of the stretching members 16 causes the previous adjacent pairs of stretching members 16 to separate and meet at the corners of the frame 14 with other stretching members 16, and in the course of that movement the band 11 is substantially stretched. With the apparatus remaining in that condition the article 10 may then be placed within the stretched band 11.

As shown in FIG. 3, the article 10 has been placed within the stretched band 11. As previously noted, rather than a single article 10, a group of articles may be placed within the band 11. The article 10 is positioned within the band 11 with each of the four corner lines of the article in one direction circumferentially thereabout closely adjacent to one of the right angle pairs of extending sections 16*b*. Each of those four article corner lines extends longitudinally of the adjacent extending sections 16*b* and substantially between the longitudinal side edges thereof. It should be understood that the foregoing description is somewhat exemplary and that in a practice of the invention relative sizes of the band 11, the article 10, and the apparatus must be correlated to achieve the operation described. Thus in reference to FIG. 3, an article 10 of the size shown must be used, it could not be larger or substantially smaller without corresponding changes in band and apparatus sizes. Those skilled in this art will understand that the apparatus may be made adjustable to accomodate articles of different sizes.

The holding of the article 10 within the band 11 as shown in FIG. 3 may be obviously accomplished in different ways, a supporting plate may be placed within or below the frame 14 or the apparatus may be positioned to place the frame 14 in a vertical rather than the horizontal plane shown.

The next operation is to again extend the cylinders 17 from the retracted positions of FIG. 3 to the extended positions of FIG. 4. Virtually as soon as the stretching members 16 begin to move from the corner positions of FIG. 3, the high compressive forces of the stretched band 11 on the stretching members 16 are transfered to the article corners, and the band 11 is thus then essentially carried about the article 10 rather than on the stretching members 16. The degree of movement of the stretching members 16 away from the frame corners necessary to transfer the band 11 is a function of the thickness of the extending sections 16*b* and the degree of roundness or sharpness of the article corners. In moving from the positions of FIG. 3 to those of FIG. 4, each extending section 16*b* moves in the flat plane of the outer wide side of that extending section and the contiguous flat plane of the inner surface of the band 11.

In the position of the apparatus shown in FIG. 4 the compressive forces of the band 11 against the extending sections 16*b* are a minimum. In reductions to practice of the invention it has been found that the article 10 can then be moved in the direction of the arrow 20 in FIG. 5 with a force slightly more than the weight force of the article 10 to remove the completed package of the article 10 and the band 11 from the apparatus.

Although eight stretching members 16 are shown in the apparatus of FIGS. 1–5, the apparatus can be modified by removing one stretching member 16 of each pair of members shown in FIG. 1 that is movable to each of the corners of the frame 14. The apparatus with the remaining four members 16 will operate substantially as described above. The primary advantage of using eight stretching members over four stretching members is that pairs of stretching members can be mutually supportive against bending under the force reaction of the band during stretching as the stretching members approach each other and meet at the corners of the frame 14. FIG. 10 which shows the extending members 16*b* in enlarged cross section is an attempt to display the mutual support of the extending members at the frame corners. FIG. 11 is a further enlarged and fragmentary view showing a pair of extending members 21 and 22 modified along the mating longitudinal edges thereof to provide a substantially locking arrangement of the extending members at the frame corners against bending under the stretching force reaction of the band 11.

Figure 7:
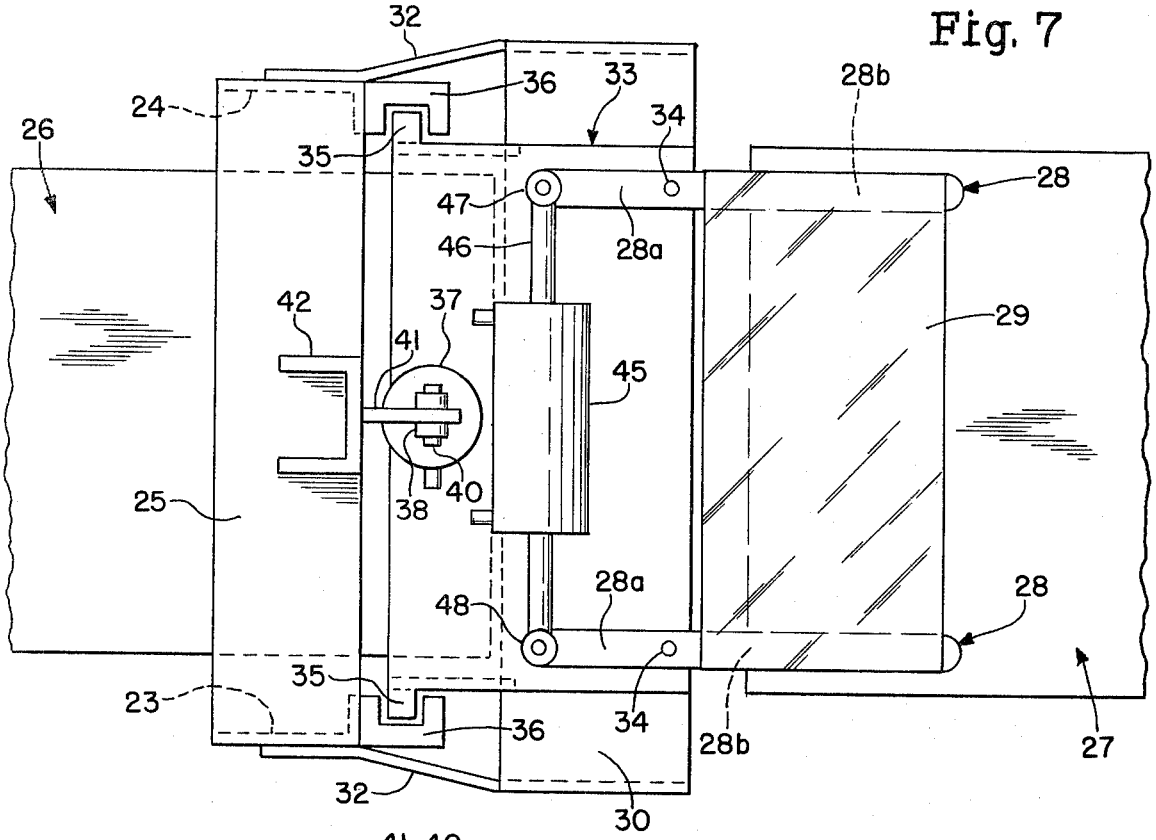
FIG. 7 is a top plan view of the assembly of FIG. 6.
Figure 6:
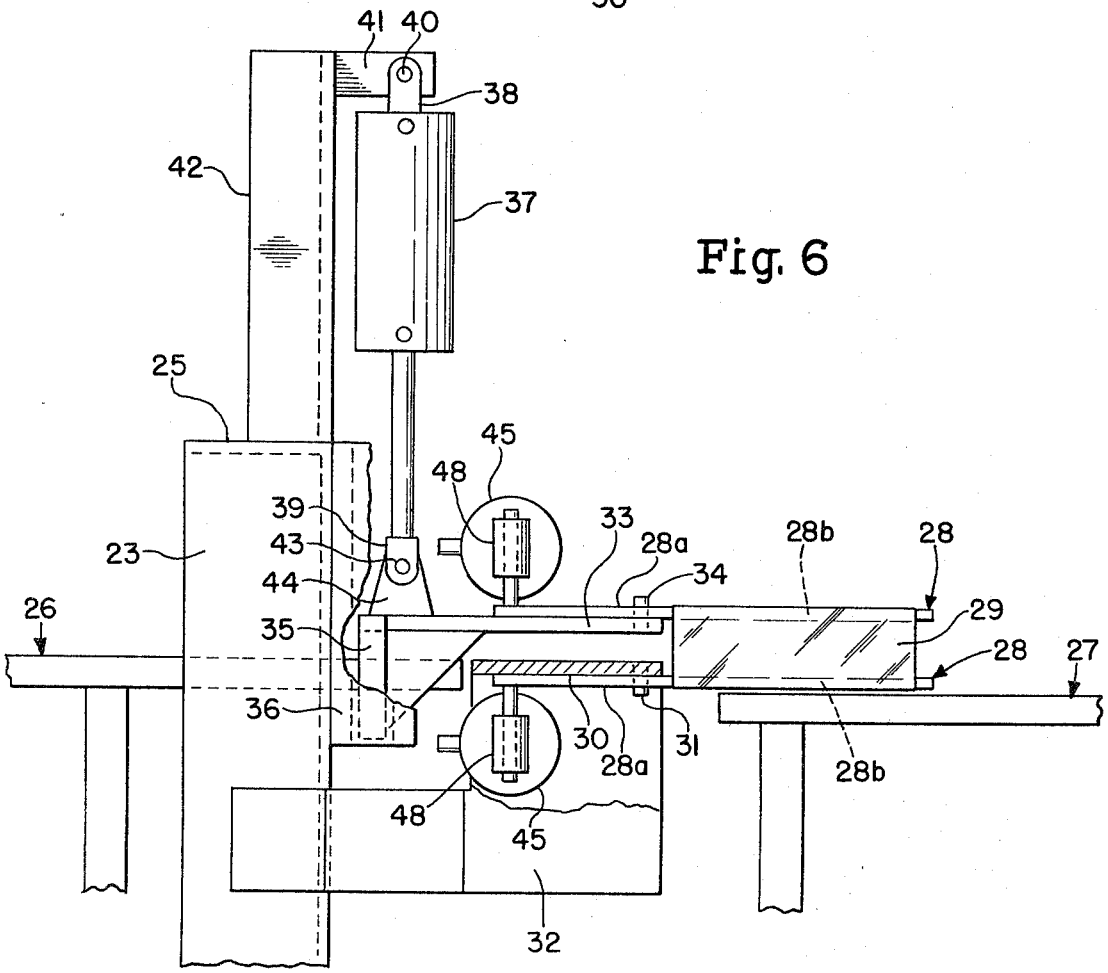
FIG. 6 is a side elevational view of another embodiment of the invention showing the stretching arms in band receiving position.

FIG. 6 in a side elevational view and FIG. 7 in a top plan view show another embodiment of the invention. The embodiment of FIGS. 6–9 shows more of a complete machine than the apparatus of FIGS. 1–5, and those skilled in this art will understand that the apparatus of FIGS. 1–5 can also in various ways be incorporated in a more complete packaging machine. As shown in FIGS. 6 and 7, the apparatus of the invention is carried on a floor mounted frame comprising a pair of spaced apart upright members 23 and 24 and top cross member 25.

An article input conveyor 26 with the leading end thereof within the apparatus supporting frame is provided. A package output conveyor 27 is also provided with the trailing end thereof disposed below the stretching members 28 of the invention.

Four stretching members 28 are provided, a lower pair and an upper pair. Each stretching member 28 comprises a mounting section 28*a* and an extending section 28*b*. The mounting section 28*a* is provided with pivotal mounting means and a rearwardly extending lever arm. The extending section 28*b* comprises a flat elongated arm of substantially greater width than thickness which is rigidly integral with and extending longitudinally from the mounting section 28*a*. The elongated arm of the extending section 28*b* must be made of a material rendering the arm sufficiently rigid to avoid any substantial bending thereof when the stretching members 28 are moved apart to stretch the band 29. The elongated arm of each extending section 28*b* has a length at least as long as the length of the portion of the band 29 to be applied about the article 13 shown in FIGS. 8 and 9.

The lower pair of stretching members 28 are pivotally mounted in a spaced apart relationship on the underside of a plate 30 by pin mounting means 31 cooperating with the pivotal mounting means on the mounting section 28*a*. In FIG. 6 the second lower stretching member 28 is behind the one shown, and in FIG. 7 it is below the upper extending member 28 shown in the upper portion of the drawing. Each end of the plate 30 is secured on one end of a vertically disposed support member 32. The support members 32 are slightly bent as shown in FIG. 7 and the other end of each member 32 is secured to one of the upright members 23 and 24 of the frame. The described mounting arrangement carries the lower stretching members 28 in a spaced apart relationship in a horizontal plane immediately above the trailing end of the package output conveyor 27.

The upper pair of stretching members 28 are pivotally mounted in a spaced apart relationship on the upper side of a plate 33 by pin mounting means 34 cooperating with the pivotal mounting means on the mounting sections 28*a*. Each end of the plate 33 is provided with a vertically aligned slide member 35. Each slide member 35 is disposed for vertical sliding movement in a way 36. The ways 36 are vertically aligned and secured to the upright members 23 and 24 of the frame. The described arrangement carries the upper stretching members 28 in a spaced apart relationship in a horizontal plane above the lower stretching members 28.

The plate 33 is moved upwardly and downwardly by a double-acting fluid-operated cylinder 37. Thd head end of the cylinder 37 is provided with a clevis 38 and the rod end is provided with a clevis 39. A pin 40 secures the head end of the cylinder 37 through the clevis 38 to one end of a short member 41. The other end of member 41 is secured to an upstanding channel member 42 the lower end of which is mounted on cross member 25 of the frame. A pin 43 secures the rod end of the cylinder 37 through the clevis 39 to a member 44. Member 44 is secured to the upper surface of the plate 33. From the foregoing description it may be seen that as the cylinder 37 is retracted the plate 33 is raised, and as it is extended the plate 33 is lowered.

The stretching members 28 are pivoted and held in any pivoted position by a pair of double-acting fluid-operated cylinders 45. The head end of each cylinder 45 is provided with an extension 46 carrying a sleeve bearing 47 on the extending end thereof. The extending end of the piston rod of each cylinder is provided with a sleeve bearing 48. The sleeve bearing 47 of one of the cylinders 45 is carried on a pin mounted to upstand from the rearward end of the lever arm of the mounting section 28*a* of one of the upper stretching members 28. The sleeve bearing 47 of the other cylinder 45 is carried on a pin mounted to depend from the rearward end of the lever arm of the mounting section 28*a* of one of the lower stretching members 28. The sleeve bearing 48 of the upper cylinder 45 is carried on a pin mounted to upstand from the rearward end of the lever arm of the mounting section 28*a* of the other upper stretching member 28. The sleeve bearing 48 of the lower cylinder 45 is carried on a pin mounted to depend from the rearward end of the lever arm of the mounting section 28*a* of the other lower stretching member 28.

The beginning operation of the embodiment of the invention shown in FIGS. 6–9 is shown in FIGS. 6 and 7. In those views the stretching members 28 are held in a parallel spaced apart relationship by the cylinders 45 and the cylinder 37 is extended to bring the upper stretching members 28 close enough to the lower stretching members 28 to permit the band 29 to be placed about the extending sections 28*b* of the stretching members 28 in a substantially unstretched condition.

Figure 8:
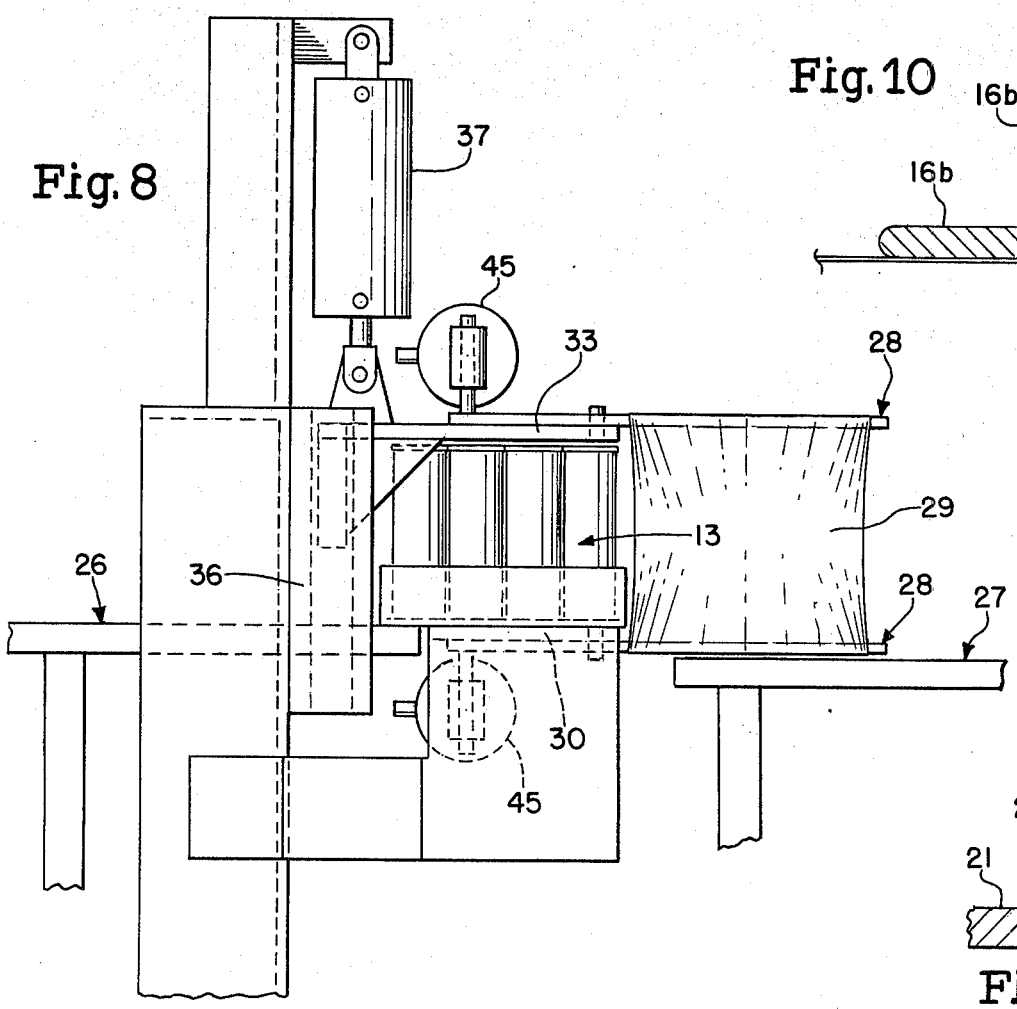
FIG. 8 is a view similar to FIG. 6 but showing the band in a stretched condition with an article in the apparatus ready for insertion within the stretched band.

The next operation is a retraction of the cylinder 37 to raise the plate 33 carrying the upper stretching members 28 to cause the band 29 to be stretched. That operated position of the apparatus is shown in FIG. 8. After the plate 33 has been raised the article 13 may be moved from the input conveyor 26 through the machine frame and onto the plate 30 and below plate 33 as shown in FIG. 8. It has been previously noted that the article 13 is a compound article of a shallow cardboard tray with thirty two cans therein disposed in a close array of four rows with eight cans in each row.

Figure 9:
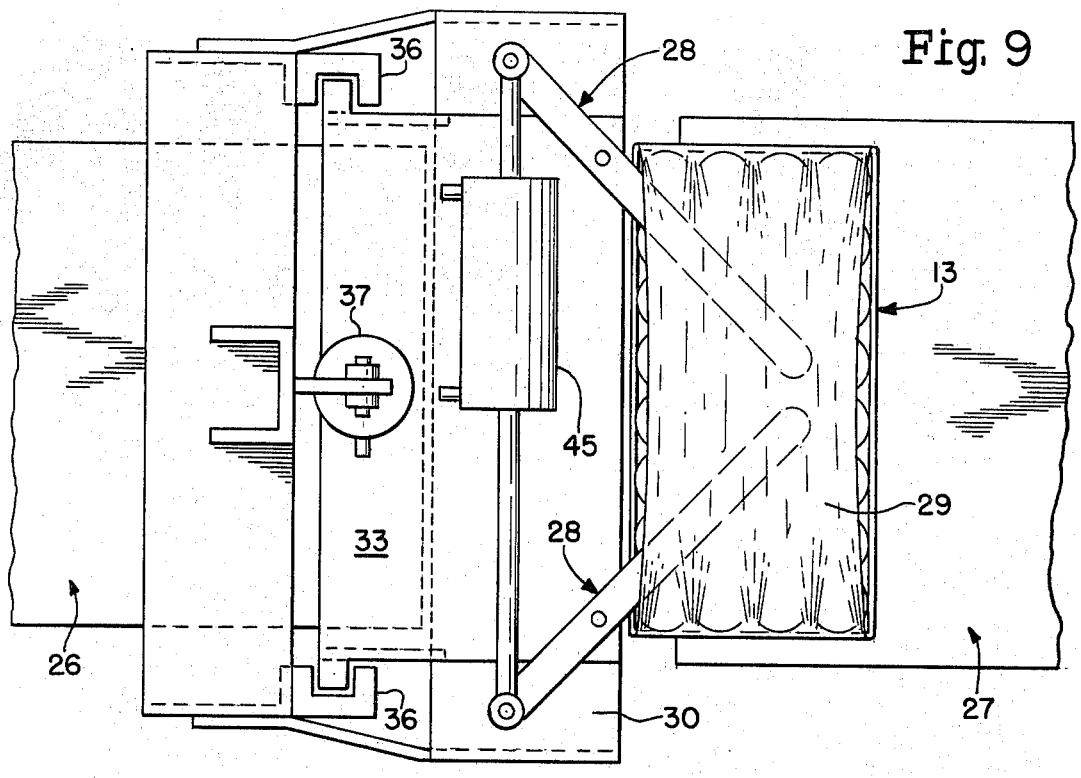
FIG. 9 is a view similar to FIG. 7 but showing the article within the stretched band and with the stretching arms having been moved to apply the band to the article.

The next operation which is a step between the showings of FIGS. 8 and 9 is a sliding of the article 13 within the stretched band 29. Although that operation may be accomplished by a person, it is contemplated that various known mechanical pusher mechanisms can be added to the machine to push the article when necessary. When the article 13 is placed within the stretched band 29 the lower end corners of the tray are on the lower stretching members 28 and are disposed longitudinally thereof between the longitudinally extending side edges thereof. The four cans in each end of the tray may be described as having an interrupted corner line at the upper outer edges thereof and that interrupted corner line is below and disposed longitudinally of the upper stretching members 28 between the longitudinally extending side edges thereof.

The next operation is shown in FIG. 9 and comprises an extension of the upper and lower cylinders 45. That operation causes the extending sections 28*b* of the upper and lower stretching members 28 to move away from the article corner lines toward the center of the upper and lower article sides. As opposed to the maintained parallel alignments of the stretching members 16 of the embodiment first described above in moving to transfer the stretched band to the article, the movement of the stretching members 28 is a pivotal movement of the extending sections 28b in flat planes contiguous with one wide side of those sections and the contiguous flat inner surfaces of the stretched band 29. As shown in FIG. 9 the package of the article 13 and the applied band 29 is completed with a minimum of compressive forces of the band 29 on the stretching members 28 and with high compressive forces of the band 29 on the article 13. In that operated condition the package may be slid from the stretching members 28 onto the output conveyor 27, and the cylinders 45 may then be retracted and the cylinder 37 may be extended to return the machine to the operated condition shown in FIGS. 6 and 7 for application of another band on the stretching members and another cycle of operation.

As noted above relative to the first embodiment described, the initial size of the band 29, and the sizes and extents of movement of the various parts of the apparatus must be correlated to the shape and size of the article to be banded. It is contemplated that the apparatus may be made adjustable to package a range of sizes of articles by a person skilled in this art.

Having described the invention, it is to be understood that changes can be made in the described embodiments by a person skilled in the art within the spirit and scope of the claims.

I claim:

1. A packaging method for an article or group of articles in which the package produced comprises said article or group of articles encircled by a band and in which the article or group of articles has at least three corner configurations extending along generally straight lines laterally spaced apart and axially directed of the area encircled by said band and in which the sides of the article between said at least three corner configurations extend for purposes of said packaging method entirely in flat planes, comprising the steps of:

providing a circumferentially continuous band of substantially uniform thickness and of a resilient elastic plastics material having the property of substantially immediate recovery upon being stretched to any degree below the elastic limit thereof at normal ambient temperatures, providing said band in an initial axial length sufficient to cover at least a substantial portion of the lengths of said corner configurations of said article or group of articles when encircled by said band, providing said band with an initial circumferential dimension sufficiently less than the circumferential dimension about said corner configurations to produce a stretched condition of said band a substantial portion of which approaches said elastic limit when said band encircles said article or group of articles about said corner configurations to produce said package, providing at least one substantially straight and rigid arm adjacent each corner configuration of said article, each arm of a length at least as long as the lengths of said substantial portion of the lengths of said corner configurations, telescopically inserting said arms axially within said band, maintaining said arms in a substantially parallel spaced apart condition while moving said arms in straight lines apart to stretch said band circumferentially thereof and sufficiently to telescopically insert said article or group of articles within said band with each of said corner configurations adjacent one of said arms, telescopically inserting said article or group of articles within said band as set forth in the immediately preceding step, moving each of said arms at a speed substantially less than the recovery rate of said band only in a single flat plane parallel to a side adjacent to it and laterally away from and in a direction relative to the adjacent corner configuration a distance sufficient to allow substantially complete recovery and contraction of said band and substantially completely transfer said stretched band to stretched engagement about said corner configurations and encircling said article or group of articles with substantially no tension forces of said band on said arms, and thereafter moving each of said arms in the flat plane parallel to its adjacent side and relative to said band to remove said arms from said band in an axial direction of said band while maintaining said substantially complete contraction of said band to produce said package.

2. In a packaging method as defined in claim 1, wherein in the pentultimate step the movement of each of said arms laterally away from the adjacent corner configuration comprises maintaining said arms parallel to the longitudinal axes of said corner configurations while said arms are moved laterally sufficiently to transfer said stretched band to stretched engagement about said corner configurations, and wherein in the last step the movement of each of said arms relative to said band is in a straight line longitudinally of said arms.

3. In a packaging method as defined in claim 1, wherein in the pentultimate step the movement of each of said arms laterally away from the adjacent corner configuration comprises a pivoting movement of each of said arms about an axis perpendicular to the plane of the portion of said band which is contiguous to each of said arms and with said axis displaced from and axially outwardly of one end of said band.

4. A packaging method for a substantially rigid article or group of articles having six sides which are generally rectangular in shape with four circumferentially adjacent sides extending for purposes of said packaging method entirely in flat planes and said method producing a package comprising said article or group of articles and at least one band encircling said four adjacent sides thereof, comprising the steps of:

(a) providing a circumferentially continuous band of substantially uniform thickness and of a resilient elastic plastics material having the property of substantially immediate recovery upon being stretched to any degree below the elastic limit thereof at normal ambient temperatures, (b) providing said band in an initial length sufficient to cover at least half of the area of each of said four adjacent sides when said band encircles said four adjacent sides, (c) providing said band with an initial circumferential dimension sufficiently less than the circumferential dimension about said four adjacent sides to produce a stretched condition of said band in which the resulting strain force in the material of said band is substantially greater than zero and less than the strain force value at a point immediately prior to the elastic limit of said material when said band encircles said four adjacent sides to produce said package, (d) providing one substantially straight and rigid arm adjacent each line of contiguity of each two adjacent sides of said four sides, each arm of a length at least as great as one half of the length of one of said four adjacent sides, (e) telescopically inserting said four arms axially within said band, (f) holding said four arms in a parallel spaced apart relationship and in a rectangular pattern while moving said four arms in straight lines apart to stretch said band circumferentially thereof and sufficiently to enable said article or group of articles to be placed within said band with each line of contiguity of each two adjacent sides of said four adjacent sides parallelly adjacent one of said four arms, (g) placing said article or group of articles within said band with each arm adjacent one of said four sides, (h) thereafter moving each of said four arms at a speed substantially less than the recovery rate of said band only in a single flat plane parallel to a side adjacent to it and laterally away from and in a direction relative to the adjacent line of contiguity of each of said two adjacent sides a distance sufficient to allow substantially complete recovery and contraction of said band and substantially completely transfer said stretched band from said four arms to stretched engagement on the lines of contiguity of said four adjacent sides with substantially no tension forces of said band on said arms, and (i) thereafter moving each of said four arms in the flat plane parallel to its adjacent side to remove said four arms from said band in an axial direction of said band while maintaining said substantially complete retraction of said band to produce said package.

5. In a packaging method as defined in claim 4, wherein in step (d) said four arms are provided as elongated straight rigid flat bars each of a width substantially greater than the thickness thereof, wherein in step (h) said bars are each further moved laterally in the flat plane through the thickness edges of each bar, and wherein the thickness of each of said bars is sufficiently small so that the frictional engagement between the inner surface of said band and the contiguous surface defined by the width and length of said bars is insufficient to cause movement of said band in a direction axially thereof from said lines of contiguity of each of said two adjacent sides of said four adjacent sides during performance of step (i).

* * * * *